US010154773B1

(12) United States Patent
Pham

(10) Patent No.: US 10,154,773 B1
(45) Date of Patent: Dec. 18, 2018

(54) ADHESIVE CLEANING SYSTEM

(71) Applicant: Chinh Duy Pham, Calgary (CA)

(72) Inventor: Chinh Duy Pham, Calgary (CA)

( * ) Notice: Subject to any disclaimer, the term of this patent is extended or adjusted under 35 U.S.C. 154(b) by 0 days.

(21) Appl. No.: 15/801,503

(22) Filed: Nov. 2, 2017

(51) Int. Cl.
*A47L 25/00* (2006.01)

(52) U.S. Cl.
CPC ..... *A47L 25/005* (2013.01)

(58) Field of Classification Search
CPC ..... A47L 25/005
USPC ..... 15/104.002
See application file for complete search history.

(56) References Cited

U.S. PATENT DOCUMENTS

| | | | |
|---|---|---|---|
| 899,726 A | 9/1908 | Goodier et al. | |
| D323,727 S | 2/1992 | Re | |
| 5,533,223 A | 7/1996 | Ho et al. | |
| 6,032,318 A | 3/2000 | McLaughlin et al. | |
| 8,015,651 B2 | 9/2011 | Knopow et al. | |
| 2007/0123384 A1 | 5/2007 | Schon et al. | |
| 2009/0126133 A1 | 5/2009 | Ryu | |
| 2016/0213222 A1 | 7/2016 | Sakashita et al. | |
| 2016/0213223 A1 | 7/2016 | Williamson | |
| 2018/0084969 A1* | 3/2018 | Doane | A47L 25/005 |

FOREIGN PATENT DOCUMENTS

| | | | |
|---|---|---|---|
| GB | 2233884 | * | 1/1991 |
| GB | 2483074 A | | 2/2012 |
| JP | 4-244128 | * | 9/1992 |
| JP | 7-227375 | * | 8/1995 |
| JP | 2000-202 | * | 1/2000 |
| JP | 3206346 B2 | | 9/2001 |
| JP | 2006-305276 | * | 11/2006 |
| JP | 2009-28228 | * | 2/2009 |
| JP | 2014018582 A | | 2/2014 |
| JP | 2014236890 A | | 12/2014 |
| JP | 2015167850 A | | 9/2015 |
| JP | 5836524 B1 | | 12/2015 |
| JP | 3206346 U | | 8/2016 |
| JP | 2016-202474 | * | 12/2016 |

* cited by examiner

*Primary Examiner* — Mark Spisich
(74) *Attorney, Agent, or Firm* — David Guerra

(57) ABSTRACT

An adhesive cleaning system for cleaning surfaces provided with a cleaning unit including at least two support arms in a spaced apart and parallel relationship with each other. Each of the support arms has a stop edge, a free end and at least one annular ridge. A first roller and a second roller each include a roller core rotatably receiving at least one of the support arms, respectively. An adhesive sheet is transferable between the rollers, with the adhesive sheet including a release liner, a first adhesive layer, a second adhesive layer and a backing layer. During use the first adhesive layer is exposed when wound on one of the rollers, with the second adhesive layer is exposed when transferred to the other roller, thereby provide multiple uses of the adhesive sheet.

20 Claims, 8 Drawing Sheets

ADHESIVE CLEANING SYSTEM

CROSS-REFERENCE TO RELATED APPLICATION

Not applicable.

STATEMENT REGARDING PRIOR DISCLOSURES BY THE INVENTOR OR A JOINT INVENTOR

Not applicable.

FEDERALLY SPONSORED RESEARCH

Not applicable.

SEQUENCE LISTING OR PROGRAM

Not applicable.

BACKGROUND OF THE INVENTION

Field of the Invention

The present invention relates to an adhesive cleaning system for use in connection with cleaning a surface using a multi-use adhesive sheet.

Description of the Prior Art

The use of cleaning devices is known in the prior art, wherein these cleaning devices utilize adhesive sheets or webs wound about a roller. The adhesive sheets are configured so that debris is adhered thereto with a continuous supply of a debris-free section of the adhesive sheet. These known devices typically include a single roller having an adhesive sheet with a sticky exterior surface that is capable of picking up debris as it is rolled over and makes contacts with a surface. These known adhesive sheets have a backing layer and a single adhesive layer on only one side thereof, thereby limiting the adhesive sheet to a single use.

However, there is a disadvantage with these known cleaning devices, which is that they have a limited number of uses that is dependent on the length of the adhesive sheet. The adhesive sheet has a surface area that is capable of securing a limited amount of debris, and the adhesive sheet has a length limiting the total surface area. Consequently, as these devices are used, the adhesive sheet will become saturated with debris and thus no longer capable of adhering debris. The roller must be continually cleaned or replaced based on the amount of debris that is adhered to the roller as it moves across the surface.

Some known cleaning devices have been developed in an attempt to overcome this disadvantage, which include a pair of rollers between which are connected a continuous web of the adhesive sheet. The adhesive sheet is capable of being advanced from a supply roller toward a take-up roller as the device is used. This arrangement provides a continuous number of new adhesive sections after the previous section have collected an amount of debris to render.

Nonetheless, these continuous sheet devices include a disadvantage in that the roller pair is not consistently aligned and thus the transferring of the adhesive sheet therebetween becomes misaligned and jammed. Additionally, these devices use the same single sided adhesive sheet, which limits the number of uses of the sheet to a single use.

To overcome this, some devices have utilized a double-sided adhesive sheet on a single roller. However, these double-sided adhesive sheets lack the capability of being transferred between a pair of rollers, and lack the capability of automatically separating a release liner when being transferred between the rollers.

While the above-described devices fulfill their respective, particular objectives and requirements, the aforementioned patents do not describe an adhesive cleaning system that allows cleaning a surface using a multi-use adhesive sheet while separating a release liner during transfer and/or aligning a pair of rollers for proper transferring of an adhesive sheet between the rollers.

Therefore, a need exists for a new and novel adhesive cleaning system that can be used for cleaning a surface using a multi-use adhesive sheet. In this regard, the present invention fulfills this need. In this respect, the adhesive cleaning system according to the present invention substantially departs from the conventional concepts and designs of the prior art, and in doing so provides an apparatus primarily developed for the purpose of cleaning a surface using a multi-use adhesive sheet.

BRIEF SUMMARY OF THE INVENTION

In view of the foregoing disadvantages inherent in the known types of roller cleaning devices now present in the prior art, the present invention provides a novel adhesive cleaning system, and overcomes the above-mentioned disadvantages and drawbacks of the prior art. As such, the general purpose of the present invention, which will be described subsequently in greater detail, is to provide a new and novel adhesive cleaning system and method which has all the advantages of the prior art mentioned heretofore and many novel features that result in an adhesive cleaning system which is not anticipated, rendered obvious, suggested, or even implied by the prior art, either alone or in any combination thereof.

To attain this, the present invention essentially provides an adhesive cleaning system providing a cleaning unit, a first and second roller, and an adhesive sheet. The cleaning unit can include at least two support arms in a spaced apart and parallel relationship with each other. The first roller and the second roller each can include a roller core having configuration capable of rotatably receiving at least one of the support arms, respectively. The adhesive sheet can have a configuration capable of being transferable between the first roller and the second roller. The adhesive sheet can include a release liner, a first adhesive layer adjacent the release liner, a second adhesive layer and a backing layer between the first adhesive layer and the second adhesive layer.

The first adhesive layer of the adhesive sheet can be exteriorly exposed when the adhesive sheet is wound on the first roller or the second roller. The second adhesive layer can be exteriorly exposed when the adhesive sheet is transferred to the first roller or the second roller other than the roller including the first adhesive layer being exteriorly exposed.

Each of the support arms can have a stop edge, a free end and at least one annular ridge located between the stop edge and the free end.

A roller urging member can be associated with each of the support arms, with the roller urging member can have a configuration capable of urging the first roller or the second roller toward the stop edge, respectively. The roller urging member can be selected from the group consisting of at least two caps each being engageable with a peripheral edge of the free end of the support arms, and a biasing member associated with the peripheral edge of the free end of the support arms.

The free end can have a configuration capable of reducing a diameter of at least a portion of the free end to less than a diameter of the annular ridge. The free end can include a plurality of members extending outwardly and radially from a longitudinal axis of the support arms.

Each of the members can include a peripheral edge having a configuration capable of creating a free end stop edge. The stop edge and the free end stop edge each can have a configuration capable of being adjacent opposite ends of the roller core received thereon, thereby positioning the corresponding roller between the stop edge and the free end stop edge.

The peripheral edge of the members can be separated from each other by a gap.

The annular ridge can be a plurality of annular ridges separated by an intermediate section with a diameter less than a diameter of the annular ridges. The intermediate section can include at least one opening or recess having a configuration capable of defining an open space adjacent an interior surface of the roller core received thereon. The plurality of annular ridges can be at least three annular ridges, and the intermediate section can be at least two intermediate sections each being between two of the at least three annular ridges.

There has thus been outlined, rather broadly, features of the invention in order that the detailed description thereof that follows may be better understood and in order that the present contribution to the art may be better appreciated.

The cleaning unit may also include a handle and a base member, with the support arms extending from the base member to create the stop edge of the support arms.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of the present invention, but nonetheless illustrative, embodiments of the present invention when taken in conjunction with the accompanying drawings.

As such, those skilled in the art will appreciate that the conception, upon which this disclosure is based, may readily be utilized as a basis for the designing of other structures, methods and systems for carrying out the several purposes of the present invention. It is, therefore, that the claims be regarded as including such equivalent constructions insofar as they do not depart from the spirit and scope of the present invention.

It is therefore an object of the present invention to provide a new and novel adhesive cleaning system that has all of the advantages of the prior art cleaning devices and none of the disadvantages.

It is another object of the present invention to provide a new and novel adhesive cleaning system that may be easily and efficiently manufactured and marketed.

An even further object of the present invention is to provide a new and novel adhesive cleaning system that has a low cost of manufacture with regard to both materials and labor, and which accordingly is then susceptible of low prices of sale to the consuming public, thereby making such adhesive cleaning system economically available to the buying public.

Still another object of the present invention is to provide a new adhesive cleaning system that provides in the apparatuses and methods of the prior art some of the advantages thereof, while simultaneously overcoming some of the disadvantages normally associated therewith.

Even still another object of the present invention is to provide an adhesive cleaning system for cleaning a surface using a multi-use adhesive sheet. This allows for cleaning a surface using a multi-use adhesive sheet while aligning a pair of rollers for proper transferring of an adhesive sheet between the rollers.

Lastly, it is an object of the present invention to provide a new and novel method of using an adhesive cleaning system, including the steps of assembling a roller core of a first roller on a first support arm of a cleaning unit. The first roller can include an adhesive sheet wound thereon. The adhesive sheet can include a release liner, a first adhesive layer adjacent the release liner, a second adhesive layer and a backing layer between the first adhesive layer and the second adhesive layer.

Assembling a roller core of a second roller on a second support arm of the cleaning unit, with the roller core of the second roller including an adhesive on an exterior surface thereof.

Transferring the adhesive sheet from the first roller to the second roller at a diagonal direction so that the second adhesive layer is exposed. After transferring, winding the adhesive sheet on the second roller until a trailing edge of the release liner is exposed. After which, attaching a portion of the exposed second adhesive layer to the roller core of the first roller.

During or after the transferring from the second roller to the first roller, separating the release liner from the first adhesive layer. The adhesive sheet can be transferred from the second roller to the first roller so that the first adhesive layer is exposed when wound about the first roller.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
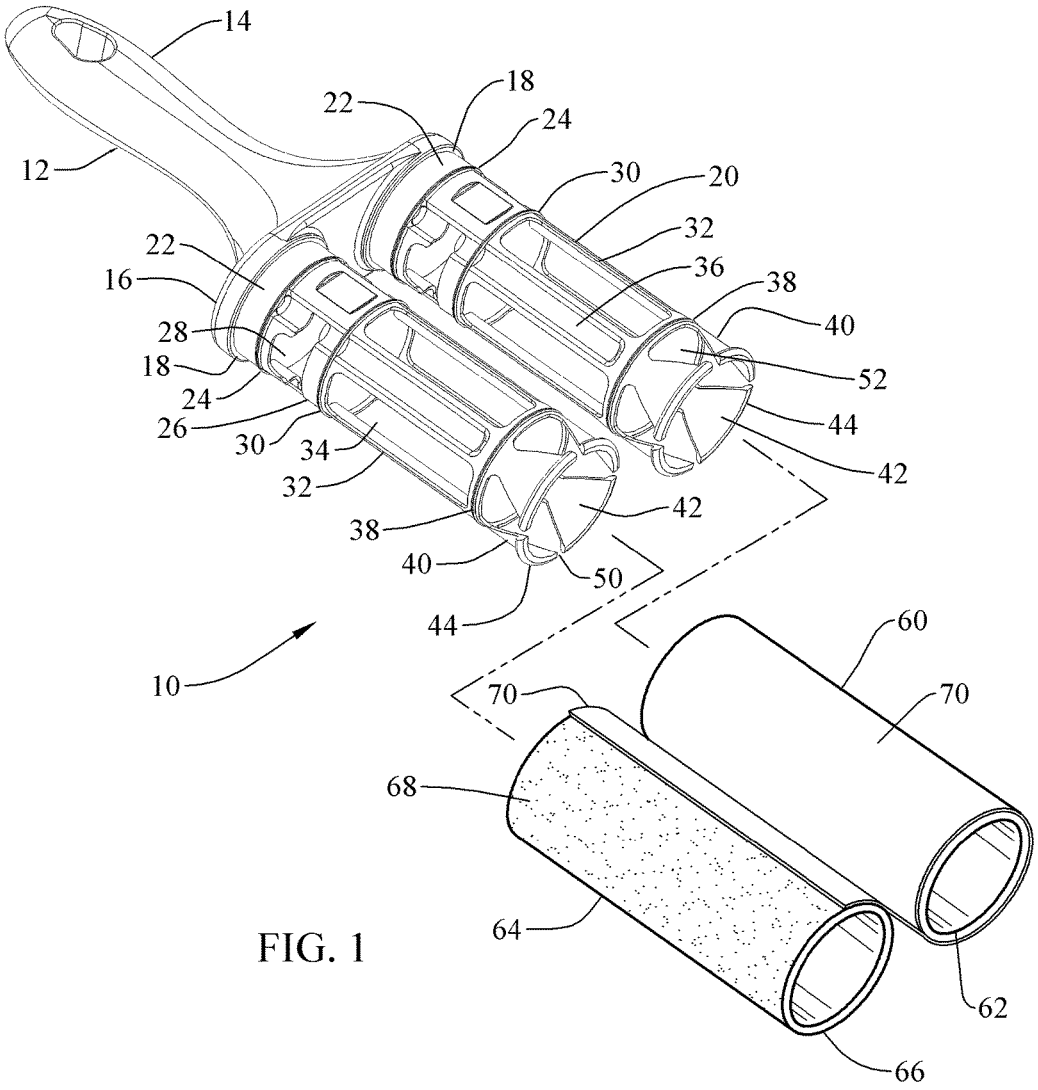
FIG. 1 is an exploded perspective view of an embodiment of the adhesive cleaning system constructed in accordance with the principles of the present invention, with phantom lines depicting environmental structure and forming no part of the claimed invention.

Referring now to the drawings, and particularly to FIGS. 1-15D, an embodiment of the adhesive cleaning system of the present invention is shown and generally designated by the reference numeral 10.

Figure 2:
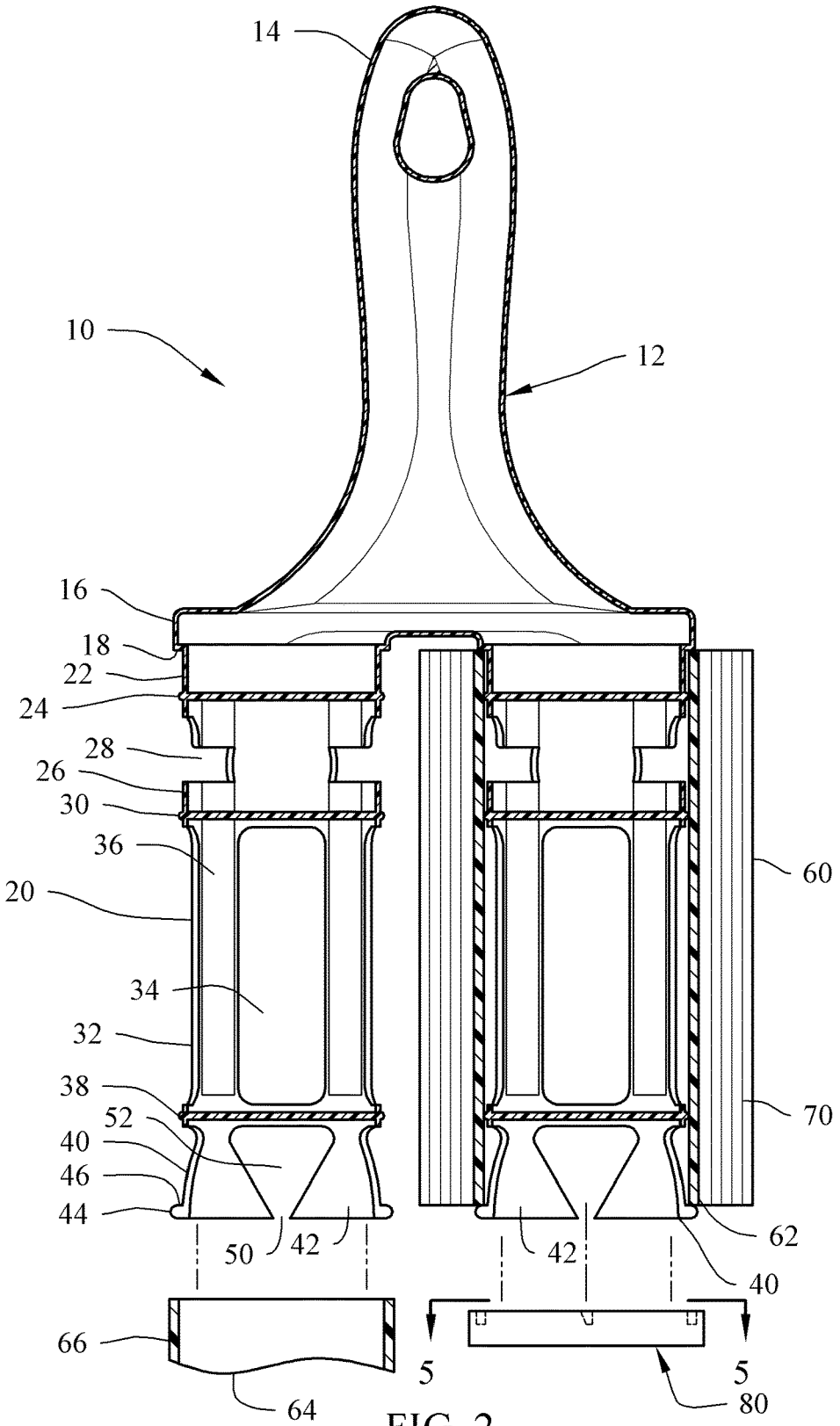
FIG. 2 is a cross-sectional view of the adhesive cleaning system with one of the rollers and the cap exploded.

In FIGS. 1 and 2, a new and novel adhesive cleaning system 10 of the present invention for cleaning a surface using a multi-use adhesive sheet is illustrated and will be described. More particularly, the adhesive cleaning system 10 has a cleaning unit 12 on to which a first roller 60 and a second roller 64 are rotatably and operable mounted. It can be appreciated that the cleaning unit 12 can be a single injection molded unit or can assembled from separate parts.

The cleaning unit 12 includes a handle 14 having a configuration capable of being grasped and manipulated by a user. The handle 14 can be an ergonomic grip or can be an elongated shaft with a grip near an end thereof, with the handle 14 being aligned or angled with the rollers 60, 64 allowing the user to manipulate and use the adhesive cleaning system 10.

A base member 16 can be associated with a portion of the handle 14, and from which extends a pair of roller support arms 20. The roller support arms 20 are parallel with each other in a spaced apart relationship, with each roller support arm 20 having a configuration capable of rotatably supporting one of the first and second rollers 60, 64, respectively. Each of the first and second rollers 60, 64 include a roller core 62, 66, respectively, and are capable of receiving an adhesive sheet 70.

It can be appreciated that the handle 14 or the base member 16 can include a motor and/or gear system for rotating each roller support arm 20 or the first and second rollers 60, 64 in the same or opposite directions.

Each roller support arm 20 has a substantially cylindrical configuration with a first end 22 extending from the handle 14 or the base member 16. The first end 22 can include a diameter less than a width or diameter of the handle 14 or the base member 16, thereby creating an annular stop edge 18 perpendicular to a longitudinal axis of the roller support arm 20.

Adjacent to the first end 22 can be at least one first core support ridge 24 that extends out annularly with a diameter greater than the diameter of the first end 22. An exterior most edge of the first core support ridge 24 can be, but not limited to, arcuate with a radius, tapered or planar. Following the first core support ridge 24 can be a first intermediate section 26 with a diameter less than the first core support ridge 24. The first intermediate section 26 can include openings or recesses 28 capable of reducing weight and/or preventing a vacuum lock with the roller core 62, 66 of the first and second rollers 60, 64 received thereon, respectively.

Adjacent to the first intermediate section 26 can be a second core support ridge 30 that extends out annularly with a diameter equal to the diameter of the first core support ridge 24. An exterior most edge of the second core support ridge 30 can have a configuration similar or different to that of the first core support ridge 24. Following the second core support ridge 30 can be a second intermediate section 32 with a diameter less than the first and second core support ridges 24, 30. The second intermediate section 32 can include openings 34 and/or recesses 36 capable of reducing weight and/or preventing a vacuum lock with the roller core 62, 66 of the first and second rollers 60, 64 received thereon, respectively.

Adjacent to the second intermediate section 32 can be a third core support ridge 38 that extends out annularly with a diameter equal to the diameter of the first and second core support ridges 24, 30. An exterior most edge of the third core support ridge 38 can have a configuration similar or different to that of the first and second core support ridges 24, 30. The second intermediate section 32 can have a length greater than, less than or equal to a length of the first intermediate section 26. The lengths of the first and second intermediate sections 26, 32 determine the position of the second core support ridge 30 on the first and second rollers 60, 64 received thereon, respectively.

Figure 3:
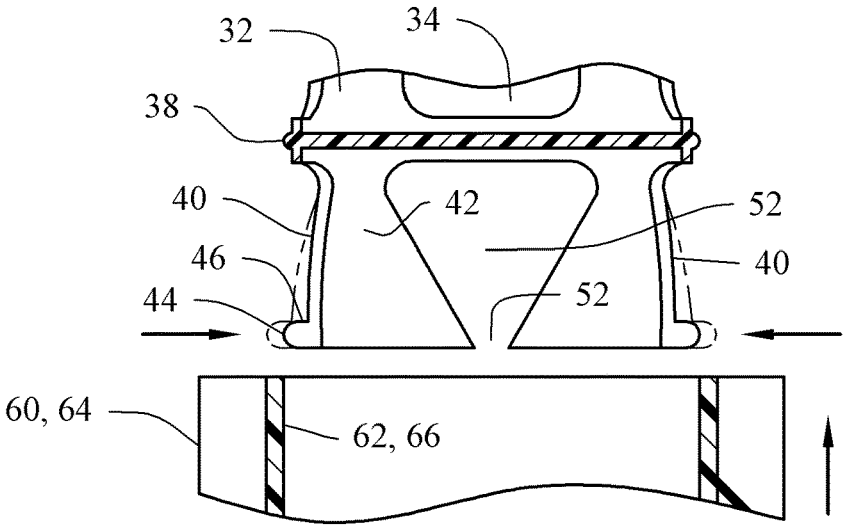
FIG. 3 is an enlarged cross-sectional view illustrating the inserting and assembling of the rollers onto a corresponding roller support arm.

Following the third core support ridge 38 can be a second end 40, which is a free end, as best illustrated in FIG. 3. The second end 40 can include a plurality of radially extending and outwardly tapering members 42. Each of the members 42 can feature a peripheral edge 44 extending outwardly in a radial manner from a terminus and perpendicular with the longitudinal axis of the roller support arm 20. The peripheral edge 44 can create an annular stop edge 46 that can be aligned with the stop edge 18 of the base member 16. Each of the members 42 can have an increasing width with a smallest width being adjacent to the third core support ridge 38 and a largest width being adjacent the peripheral edge 44. This increasing width can provide a generally triangular configuration for each of the members 42.

Between each of the members 42 can be defined a gap 50 that leads to an opening 52. The opening 52 has a configuration similar to that of, but reversed with, the members 42.

The members 42 can form a generally conical configuration with the peripheral edges 44 forming an annular edge with a diameter greater than the diameter of the first, second and third core support ridges 24, 30, 38. The outwardly tapering triangular configuration of each of the members 42, along with the gaps 50 and the openings 52, allows each of the members 42 to bend in an inwardly direction. This flexibility of each of the members 42 can provide the ability to reduce the general diameter of the peripheral edges 44 of the second end 40 so as to be less than the diameter of the first, second and third core support ridges 24, 30, 38 and the roller core 62, 66 of the rollers 60, 64, as best illustrated in FIG. 3.

The user can manually squeeze the members 42 toward each other thereby reducing the overall diameter of the peripheral edges 44 of the second end 40. It can be appreciated that a ring (not shown) can be positioned exterior of the members 42 between the peripheral edges 44 and the third core support ridge 38. The ring can have a diameter less than the diameter of the third core support ridge 38, and thus sliding the ring along the members 42 would squeeze all the members 42 simultaneously.

The roller core 62, 66 of the first and second roller 60, 64 can have a diameter greater than the diameter of the first, second and third core support ridges 24, 30, 38, thereby allowing the roller support arm 20 to be inserted into the roller core 62, 66 and allowing for the rollers 60, 64 to be rotated about the roller support arm 20, respectively. It can be appreciated that the rollers 60, 64 can easily slide on and receive their corresponding roller support arm 20. It can further be appreciated that the roller core 62, 66 can be frictionally fitted to their respective support arm 20, with each support arm 20 being rotatably coupled to the handle 14 or the base member 16.

A length between the stop edge 18 of the base member 16 and the stop edge 46 of the second end 40 can be configured to substantially correspond with a length of the rollers 60, 64. This length can be slightly greater than the roller length, thereby allowing for free rotation of the rollers 60, 64, while at the same time aligning the rollers 60, 64 for proper transfer of the adhesive sheet 70. When assembled, a first end of the roller core 62, 66 abuts the stop edge 18 of the base member 16, while a second end of the roller core 62, 66 abuts the stop edge 46 of the second end 40. The stop edges 18, 46 keep the rollers 60, 64 aligned with each other.

Figure 4:
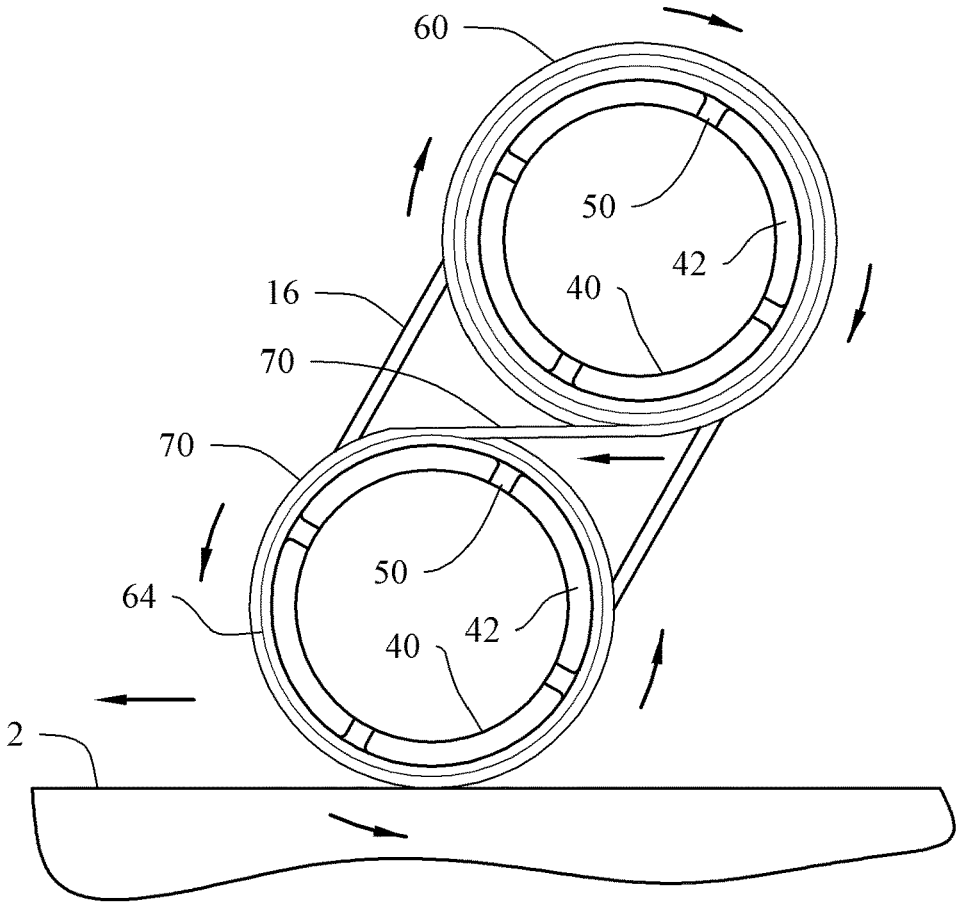
FIG. 4 is a front view of the diagonal transfer of the adhesive sheet between the first and second rollers.
Figure 5:
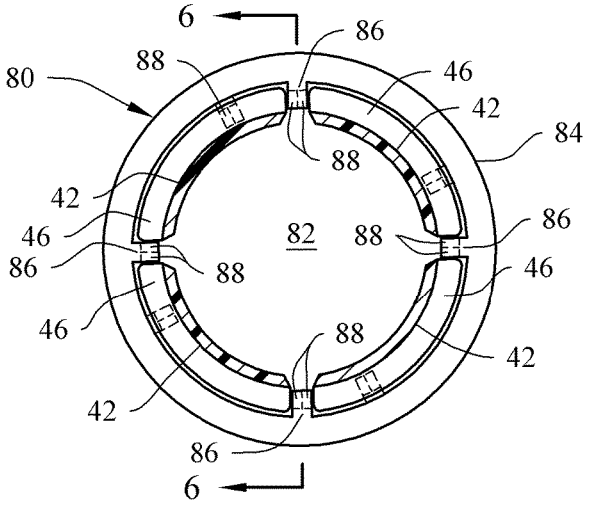
FIG. 5 is a cross-sectional view of the cap of the present invention orientated with the second end in an insertion position and a rotated position.
Figure 6:
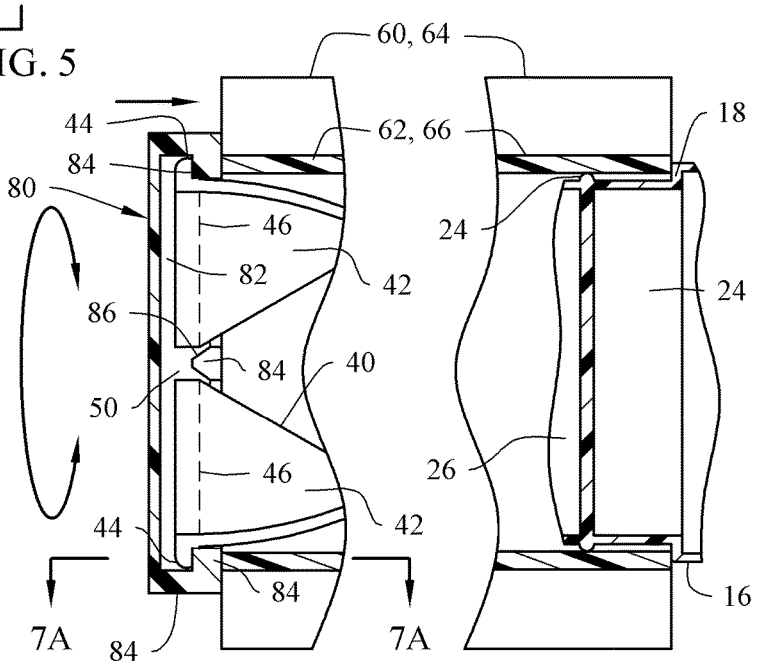
FIG. 6 is an enlarged cross-sectional view of the cap and engaged with the second end of the roller support arm taken along line 6-6 in FIG. 5.

Referring to FIG. 4, with the first and second rollers 60, 64 assembled on their corresponding roller support arm 20, the adhesive sheet 70 can be transferred from one roller to other at a diagonal direction therebetween. The multi-use aspect and the diagonal transferring of the adhesive sheet 70 will be described in further detail herewithafter.

During use, one of the roller support arms 20 can be orientated so that its corresponding roller 60, 64 can be in contact with a surface 2 to be cleaned. The user would move the cleaning unit 12 so that the roller 60, 64 travels along the surface 2 thereby pulling the adhesive sheet 70 from the other roller and thus providing a clean section of the adhesive sheet 70. The diagonal direction of transfer of the adhesive sheet 70 rotates the supplying roller in a direction opposite to that of the receiving roller which can be contact with the surface 2

The adhesive cleaning system 10 can optionally include a cap 80 attachable to the second end 40 of each roller support arm 20, as best illustrated in FIGS. 2 and 5-7B. The cap 80 can have a configuration, when in operation, capable of urging the roller 60, 64 toward the stop edge 18 of the base member 16. This urging of each of the first and second rollers 60, 64 toward the base member 16 would provide constant alignment of the rollers 60, 64, even of rollers that have a length considerably less than the length between the stop edge 18 of the base member 16 and the stop edge 46 of the second end 40.

Figure 7A:
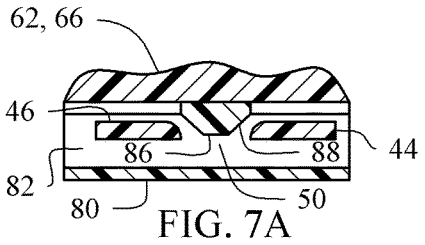
FIG. 7A is a cross-sectional view of the cap assembled on the second end in the inserted position taken along line 7A-7A in FIG. 6.

The cap 80 includes an interior space 82 defined by at least one side wall 84. A plurality of teeth members 86 extend perpendicular from the side wall 84 toward each other. Each of the teeth members 86 includes an angled ramp portion 88 extending from a head portion of the members 86 in a direction toward the interior space 82 and parallel with a longitudinal axis of the cap 80. The members 86 have a width less than a width of the gap 50 allowing the members 86 to pass through the gaps 50 when the cap 80 is assembled on the second end 40, as best illustrated in FIG. 7A.

Figure 7B:
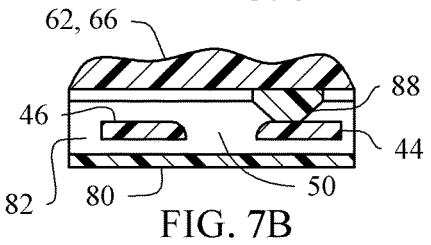
FIG. 7B is a cross-sectional view of the cap rotatably engaged with the peripheral edge of the second end.

Upon rotation of the cap 80, the members 86 and their corresponding angled portion 88 have a configuration capable of advancing the cap 80 along the longitudinal axis of the roller support arm 20 in a direction toward the base member 16, as best illustrated in FIG. 7B. This advancing motion can be provided by the angled portion 88 contacting the stop edge 46 of the second end 40. Further rotation of the cap 80 increases an area of the angled portion 88 that contacts the stop edge 46, thereby moving the cap 80 toward the base member 16.

As the cap 80 advances toward the base member 16, the side wall 84 and/or members 86 contacts the roller core 62, 66, which urges the roller core 62, 66 and thus the rollers 60, 64 toward the stop edge 18 of the base member 16. Consequently, each roller 60, 64 can be aligned with each other because of their urged position against their corresponding stop edge 18.

Figure 8:
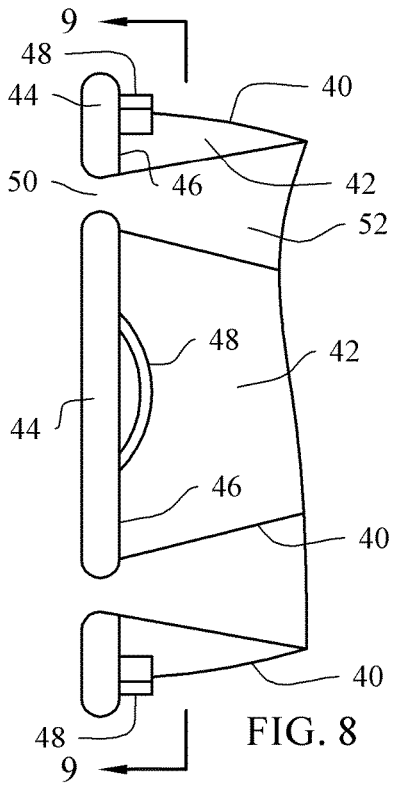
FIG. 8 is an enlarged view of an alternate embodiment of the second end of the roller support arm including the biasing member of the present invention.
Figure 10:
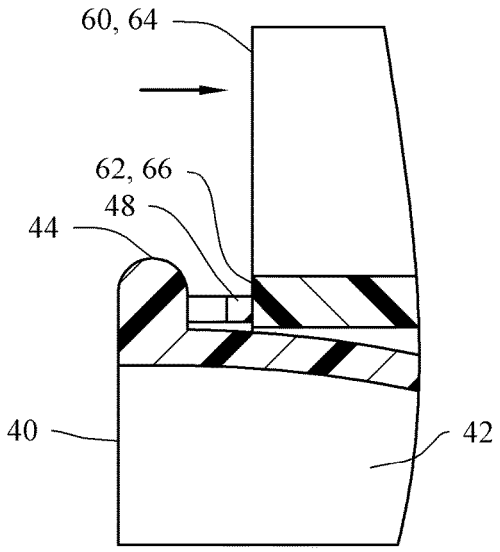
FIG. 10 is a cross-sectional view of the alternate embodiment second end taken along line 10-10 in FIG. 9.
Figure 9:
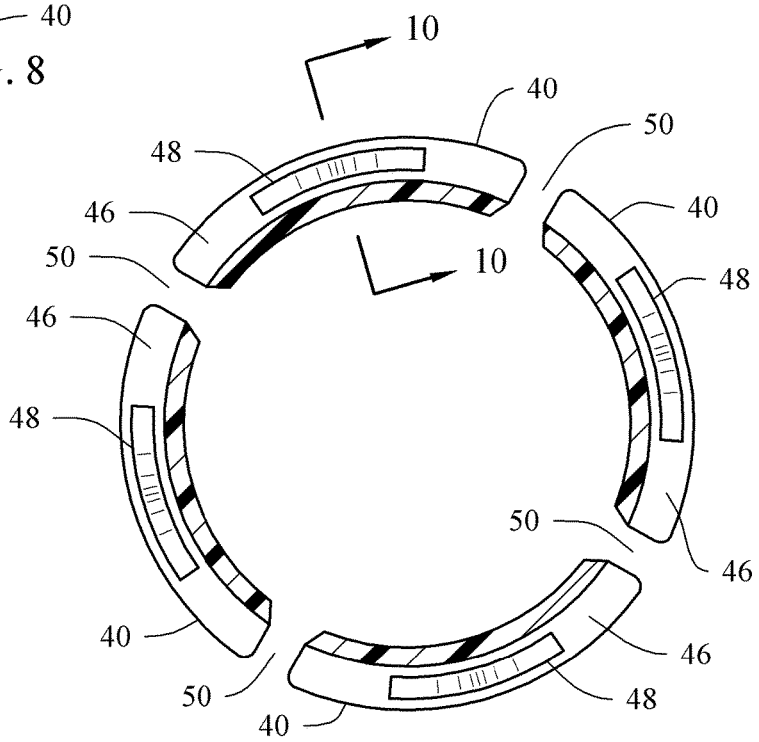
FIG. 9 is a cross-sectional view of the alternate embodiment second end taken along line 9-9 in FIG. 8.

Referring to FIGS. 8-10, an alternative embodiment roller urging means is described. Each of the stop edges 46 of the second end 40 can include at least one biasing member 48 extending from the stop edge 46 toward the base member 16 in a direction substantially parallel with the longitudinal axis of the roller support arm 20. It can be appreciated that the biasing member 48 can be, but not limited to, a spring, a leaf spring, a cantilevered arm, a magnet, a compressible element with shape memory characteristics or a member capable of providing an outward force.

Upon squeezing the members 42 of the second end 40, and sliding the roller 60, 64 onto their respective roller support arm 20, the biasing member 48 is juxtaposition with the roller core 62, 66. The biasing member 48 can urge the roller core 62, 66 and thus the rollers 60, 64 toward the stop edge 18 of the base member 16. Consequently, each roller 60, 64 can be aligned with each other because of their urged position against their corresponding stop edge 18.

It can be appreciated that the biasing member 48 can be a magnet, with the roller core 62, 66 having an additional magnet in a repulsive configuration so as to create the urging force that pushes the roller 60, 64 toward the base member 16. The magnets can remove any rotational friction loss between the roller core 62, 66 and the second end 40.

Figure 11:
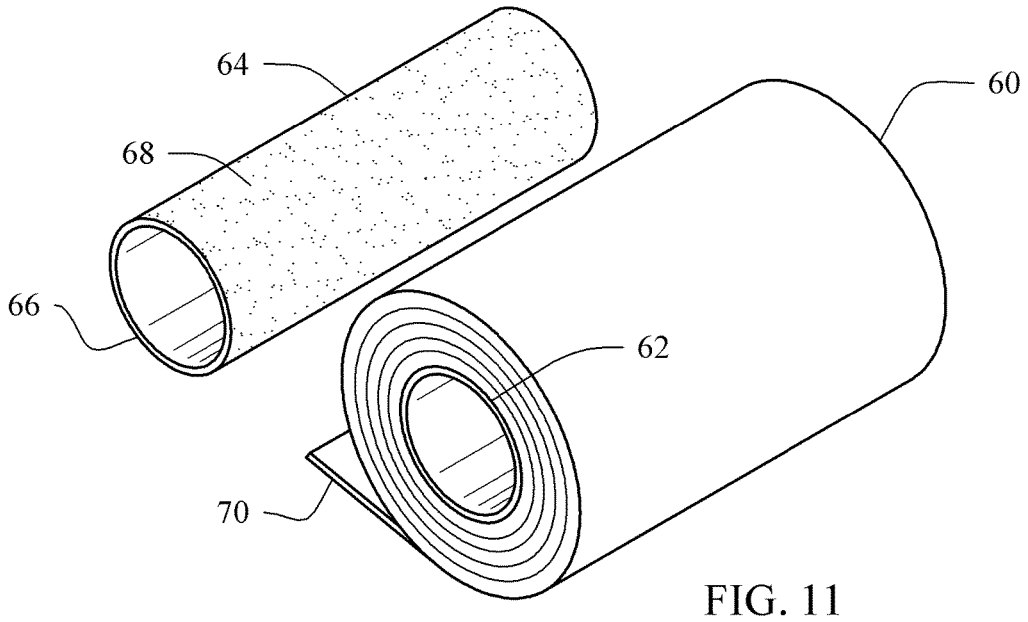
FIG. 11 is a perspective view of the first and second rollers and the adhesive sheet of the present invention.
Figure 12:
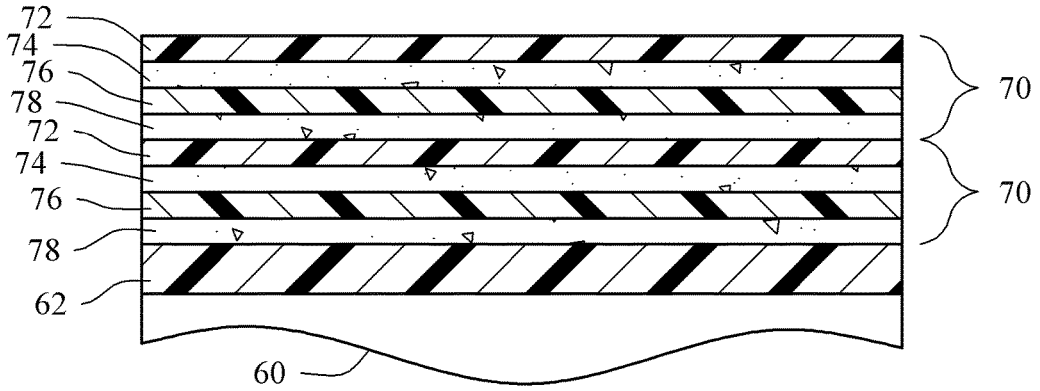
FIG. 12 is a cross-sectional view of layers of the adhesive sheet.

Referring now to FIGS. 11 and 12, the first and second rollers 60, 64 and adhesive sheet 70 arrangements will be described. For exemplary purposes, the first roller 60 will be described as a supply roller with the second roller 64 being described as a receiving roller. However, it can be appreciated that the function of the supply and receiving rollers will be reversed upon completion of an initial use of the adhesive sheet, which will be described further herewithafter.

The first and second rollers 60, 64 can include the roller core 62, 66, each with an adhesive exterior 68. The supply roller 60 includes a continuous roll of adhesive sheet 70, which can be transferable to the receiving roller 64 upon use. The adhesive sheet 70 includes a release liner 72 exterior of a first adhesive layer 74, a second adhesive layer 78, and a backing layer 76 between the first and second adhesives layers 74, 78. It can be appreciated that the release liner 72 separates the first adhesive layer 74 from the second adhesive layer 78 when the adhesive sheet 70 can be wound around the roller core 62, 66. This can prevent the first and second adhesive layers 74, 78 from sticking together.

The first and second adhesives layers 74, 78 can provide the multi-use aspect of the present invention, since the adhesive sheet 70 can be used more than once, depending on which of the first and second adhesives layers 74, 78 is exposed.

Figure 13:
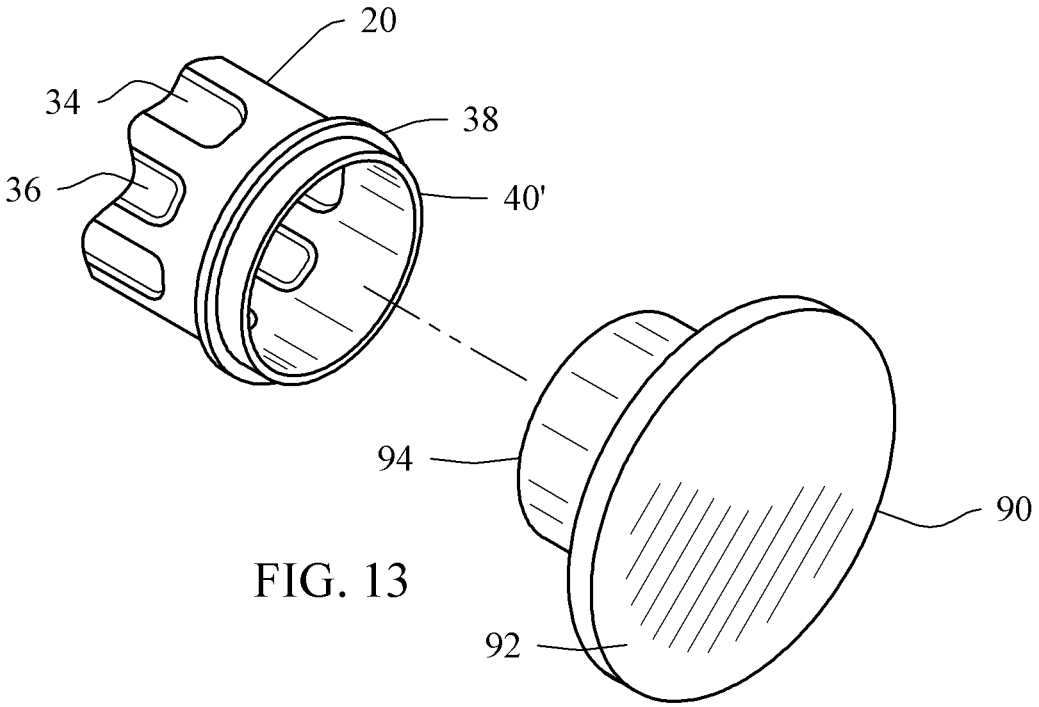
FIG. 13 is a perspective view of an alternate embodiment second end of the support arms and an alternate embodiment cap.
Figure 14:
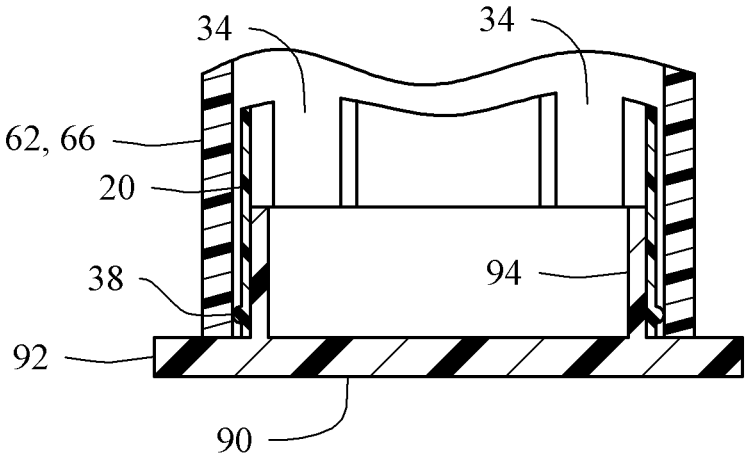
FIG. 14 is a cross-sectional view of the alternate cap assembled with the second end.

Referring to FIGS. 13 and 14, an alternative embodiment second end 40' of the roller support arms 20 and a cap 90 is described. The second end 40' is a free end of the roller support arms 20 with a hollow interior or opening, and is without the outwardly tapering members. The second end 40' can extend from the third core support ridge 38 or can include the third core support ridge 38. It can be appreciated that the second end 40' can have a diameter less than or equal to the third core support ridge 38.

The cap 90 can include a closed end 92, and an engagement end 94 extending from the closed end 92. The closed end 92 can have a diameter greater than the diameter of the third core support ridge 38 or the roller core 62, 66 of the rollers 60, 64. The engagement end 94 can have a diameter less than an interior diameter of the second end 40' or the roller support arms 20, thus allowing the engagement end 94 to be inserted and received through the hollow interior of the second end 40'. The engagement end 94 can be securely fitted in the second end 40' by way of, but not limited to, friction, threaded engagement, fasteners or latches.

It can be appreciated that the roller core 62, 66 or the roller support arms 20 can have a length allowing the roller core 62, 66 to extend out past the second end 40'. With the engagement end 94 being threadable engageable with an interior surface of the second end 40' or the roller support arms 20. This configuration allows for the advancing of the cap toward the roller support arms 20 by rotating the cap 90. Continued rotation of the cap 90 would increase the advancement toward the roller 60, 64 assembled on the support arm 20, and consequently urge the roller 60, 64 toward the stop edge 18.

With the roller core 62, 66 assembled on the roller support arms 20, the cap 90 can be attached to the second end 40' by inserting the engagement end 94 into the second end 40'. The closed end 92 can contact the roller core 62, 66 thereby urging the roller 60, 64 toward the stop edge 18, as best illustrated in FIG. 14. Consequently, each roller 60, 64 can be aligned with each other because of their urged position against their corresponding stop edge 18.

In use, as best illustrated in FIGS. 15A-15D, it can now be understood the multi-use aspect of the adhesive sheet 70. The user can first install the first and second rollers 60, 64 onto their corresponding roller support arm 20. To begin initial use of the adhesive cleaning system 10, a leading edge of the adhesive sheet 70 can be pulled in a diagonal direction from the supply roller 60 to the receiving roller 64, as per FIG. 15A, so that the release liner 72 is placed in contact with the adhesive exterior 68 of the receiving roller 64. Consequently, this exposes the second adhesive layer 78 exterior of the receiving roller 64.

To clean the surface of debris, the receiving roller 64 is placed in contact with the surface so that the exposed second adhesive layer 78 can contact the surface. The user can then roll the adhesive cleaning system 10 along the surface. This rolling action rotates the receiving roller 64 which pulls and transfers clean sections of the adhesive sheet 70 from the supply roller 60, which rotates in a direction opposite of the receiving roller 64 due to the diagonal transfer direction.

Upon completion of transferring of the adhesive sheet 70 from the supply roller 60 to the receiving roller 64, the second roller 64 now becomes the supply roller and the first roller 60, which is empty of adhesive sheet 70, now becomes the receiving roller.

Figure 15A:
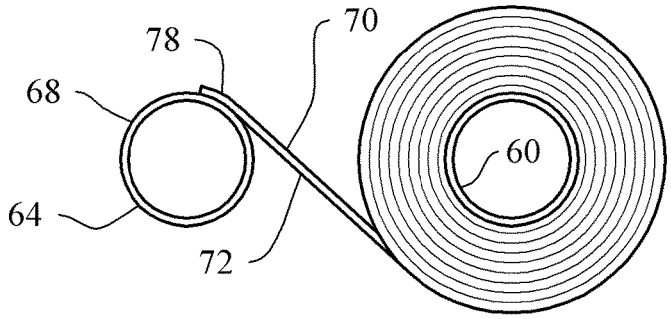
FIGS. 15A-15D is a front view of the operational steps of the adhesive sheet in use.
Figure 15B:
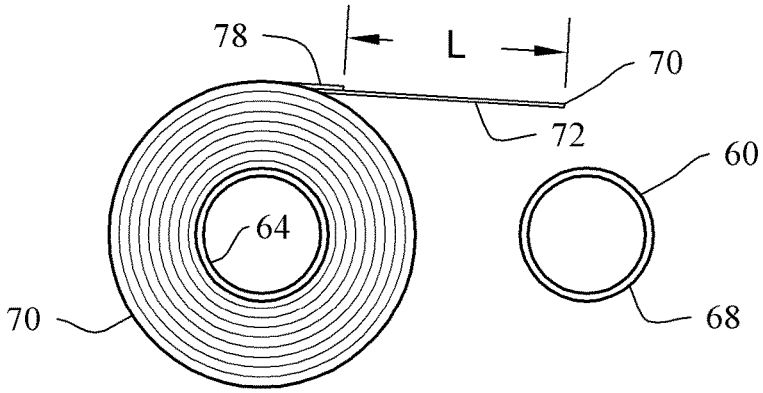

The release liner 72 can have an overall length that is longer than the first and second adhesive layers 74, 78. This provides a trailing edge length L of the release liner 72 that extends past the first and second adhesive layers 74, 78, as best illustrated in FIG. 15B.

Figure 15C:
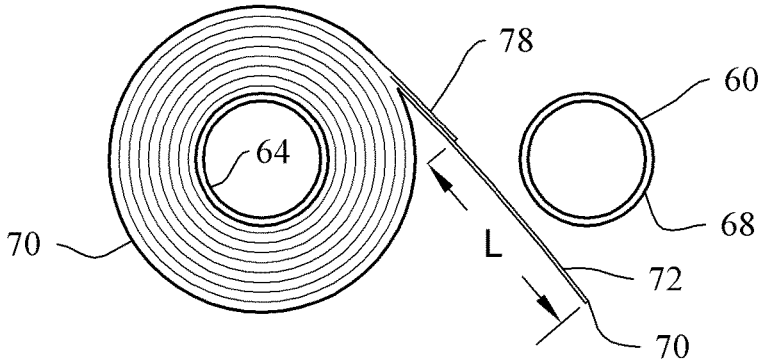

At this point the initial use the adhesive sheet 70 is complete, and the user can now arrange the adhesive sheet 70 for a secondary use. To do this, the user can pull the trailing edge length L of the exposed released liner 72 in a diagonal direction similar to the previous diagonal direction, as best illustrated in FIG. 15C.

Figure 15D:
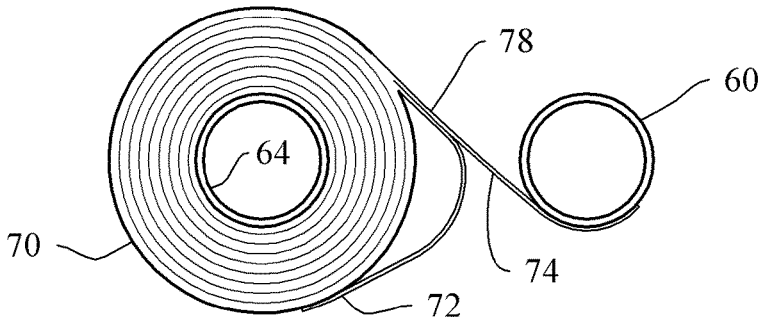

The used second adhesive layer 78 is placed in contact with the adhesive exterior 68 of the receiving roller 60, while the release liner 72 is separated from the first adhesive layer 74, as best illustrated in FIG. 15D. The trailing edge length L of the exposed released liner 72 is capable of being adhered to the second adhesive layer 78 of the supply roller 64 prior to transferring of the adhesive sheet 70 to the receiving roller 60. The second adhesive layer 78 can have sufficient remaining adhesion to secure the release liner 72 thereto and separate the release liner 72 from the first adhesive layer 74.

To clean a surface of debris using the first adhesive layer 74 (secondary use of the adhesive sheet 70), the receiving roller 60 is placed in contact with the surface so that the exposed first adhesive layer 74 can contact the surface. The user can then roll the adhesive cleaning system 10 along the surface. This rolling action rotates the receiving roller 60 which pulls and transfers clean sections of the first adhesive layer 74 from the supply roller 64, which rotates in a direction opposite of the receiving roller 60 due to the diagonal transfer direction.

Continued rolling of the receiving roller 60 will unwind the adhesive sheet 70 from the supply roller 64 and wind it onto the receiving roller 60 with the release liner 72 being between the first and second adhesive layers 74, 78.

Upon completion of transferring of the adhesive sheet 70 from the supply roller 64 to the receiving roller 60, the adhesive sheet 70 has completed its second use cycle. After which, the user can replace the first and second rollers 60, 64 with a new set, thereby providing the user with another two cycles of use.

The present invention concerns an improved debris cleaning roller that comes with two cylindrical cores that support a double-sided roll of adhesive sheet in a way that allows the whole roll to be dispensed moving from one arm to the other in a diagonal direction.

The length of each arm can equal the length of the roller refill or can be longer to allow a space between an end of the roller and the stop edge of the second end. The tight clearances in length can prevent each roll from wriggling up and down keeping them both intact and perfectly parallel to each other during the course of cleaning. The second end of each arm can be raised and round-like configuration, so when it contacts the core of the roll, it doesn't make the circular movement of the roll difficult but smooth.

The adhesive sheet and roller package of the present invention can include two components, being an empty core coated with adhesive/sticky substance for initial sheet pick-up from a supply roll. The adhesive sheet can be a double sided adhesive sheet, including a release liner that can be longer. The extra length of the release liner, the difference between the circumference of the supply roll and that of the receiving roll, can be meant to help prevent the two adhesive layers from contacting during the roll transitions.

While embodiments of the adhesive cleaning system have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material may be used instead of the above-described. And although cleaning a surface using a multi-use adhesive sheet have been described, it should be appreciated that the adhesive cleaning system herein described is also suitable for providing dual use cleaning operation from a single adhesive sheet.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adhesive cleaning system comprising:

a cleaning unit comprising at least two support arms in a spaced apart and parallel relationship with each other, each of said support arms having a stop edge, and a free end;

a first roller and a second roller each including a roller core having configuration capable of rotatably receiving at least one of said support arms, respectively; and an adhesive sheet having a configuration capable of being transferable between said first roller and said second roller, said adhesive sheet including a release liner, a first adhesive layer adjacent said release liner, a second adhesive layer and a backing layer between said first adhesive layer and said second adhesive layer.

2. The adhesive cleaning system of claim 1, wherein a section of said first adhesive layer being exteriorly exposed when said adhesive sheet is wound on said first roller or said second roller, and a section of said second adhesive layer being exteriorly exposed when said adhesive sheet is transferred to said first roller or said second roller other than said first roller or said second roller including said first adhesive layer being exteriorly exposed.

3. The adhesive cleaning system of claim 1, wherein each of said support arms including at least one annular ridge located between said stop edge and said free end, and wherein said free end has a configuration capable of reducing a diameter of at least a portion of said free end to less than a diameter of said annular ridge.

4. The adhesive cleaning system of claim 3, wherein said free end of each of said support arms includes a plurality of members extending outwardly and radially from a longitudinal axis of said support arms.

5. The adhesive cleaning system of claim 4, wherein each of said members include a peripheral edge having a configuration capable of creating a free end stop edge, said stop edge and said free end stop edge each having a configuration capable of being adjacent opposite ends of said roller core received thereon.

6. The adhesive cleaning system of claim 5, wherein said peripheral edge of said members are separated from each other defining a gap.

7. The adhesive cleaning system of claim 3, wherein said annular ridge being a plurality of annular ridges separated by an intermediate section with a diameter less than a diameter of said annular ridges.

8. The adhesive cleaning system of claim 7, wherein said intermediate section features at least one opening or recess having a configuration capable of defining an open space adjacent an interior surface of said roller core received thereon.

9. The adhesive cleaning system of claim 8, wherein said annular ridges being at least three annular ridges, said intermediate section being at least two intermediate sections each being between two of said at least three annular ridges.

10. The adhesive cleaning system of claim 1 further comprising a roller urging member associated with each of said support arms, said roller urging member having a configuration capable of urging said first roller or said second roller toward said stop edge, respectively.

11. The adhesive cleaning system of claim 10, wherein said roller urging member is selected from the group consisting of at least two caps each being engageable with said free end of said support arms, and a biasing member associated with a peripheral edge of said free end of said support arms.

12. The adhesive cleaning system of claim 1, wherein said cleaning unit further comprising a handle and a base member, with said support arms extending from said base member to create said stop edge of said support arms.

13. An adhesive cleaning system comprising:

a cleaning unit comprising at least two support arms in a spaced apart and parallel relationship with each other;

a first roller and a second roller each including a roller core having configuration capable of rotatably receiving at least one of said support arms, respectively; and an adhesive sheet having a configuration capable of being transferable between said first roller and said second roller, said adhesive sheet including a release liner, a first adhesive layer adjacent said release liner, a second adhesive layer and a backing layer between said first adhesive layer and said second adhesive layer;

wherein said first adhesive layer being exteriorly exposed when said adhesive sheet is wound on said first roller or said second roller, and said second adhesive layer being exteriorly exposed when said adhesive sheet is transferred to said first roller or said second roller other than said first roller or said second roller including said first adhesive layer being exteriorly exposed.

14. The adhesive cleaning system of claim 13, wherein said adhesive sheet has a configuration capable of said release liner separating from said first adhesive layer at least during a transferring of said adhesive sheet between said first roller and said second roller.

15. The adhesive cleaning system of claim 13, wherein said adhesive sheet being transferred between said first roller and said second roller at a diagonal direction.

16. The adhesive cleaning system of claim 13, wherein each of said support arms having a stop edge, a free end and at least one annular ridge located between said stop edge and said free end.

17. The adhesive cleaning system of claim 16, wherein said free end has a configuration capable of reducing a diameter of at least a portion of said free end to less than a diameter of said annular ridge.

18. The adhesive cleaning system of claim 16, wherein said free end of each of said support arms includes a plurality of members extending outwardly and radially from a longitudinal axis of said support arms.

19. The adhesive cleaning system of claim 18, wherein each of said members include a peripheral edge having a configuration capable of creating a free end stop edge, said stop edge and said free end stop edge each having a configuration capable of being adjacent opposite ends of said roller core received thereon.

20. A method of using an adhesive cleaning system, said method comprising the steps of:

assembling a roller core of a first roller on a first support arm of a cleaning unit, said first roller including an adhesive sheet wound thereon, said adhesive sheet including a release liner, a first adhesive layer adjacent said release liner, a second adhesive layer and a backing layer between said first adhesive layer and said second adhesive layer;

assembling a roller core of a second roller on a second support arm of said cleaning unit, said roller core of said second roller including an adhesive on an exterior surface thereof;

transferring said adhesive sheet from said first roller to said second roller at a diagonal direction so said second adhesive layer is exposed;

winding said adhesive sheet on said second roller until a trailing edge of said release liner is exposed;

attaching a portion of said second adhesive layer to said roller core of said first roller;

separating said release liner from said first adhesive layer; and transferring said adhesive sheet from said second roller to said first roller so that said first adhesive layer is exposed when wound about said first roller.

* * * * *